US009423207B2

(12) United States Patent
Hunkley

(10) Patent No.: US 9,423,207 B2
(45) Date of Patent: Aug. 23, 2016

(54) PISTOL RECOIL REDUCTION DEVICE

(71) Applicant: Clint Joseph Hunkley, Dale City, VA (US)

(72) Inventor: Clint Joseph Hunkley, Dale City, VA (US)

( * ) Notice: Subject to any disclaimer, the term of this patent is extended or adjusted under 35 U.S.C. 154(b) by 0 days.

(21) Appl. No.: 14/675,014

(22) Filed: Mar. 31, 2015

(65) Prior Publication Data

US 2015/0323283 A1 Nov. 12, 2015

Related U.S. Application Data

(60) Provisional application No. 61/990,784, filed on May 9, 2014.

(51) Int. Cl.

| | |
|---|---|
| ***F41C 23/06*** | (2006.01) |
| ***F41C 23/10*** | (2006.01) |
| ***F41C 23/04*** | (2006.01) |
| ***F41C 23/12*** | (2006.01) |

(52) U.S. Cl.

CPC ..... *F41C 23/06* (2013.01); *F41C 23/04* (2013.01); *F41C 23/10* (2013.01); *F41C 23/12* (2013.01)

(58) Field of Classification Search

CPC ..... F41C 23/06; F41C 23/10; F41C 23/12
USPC ..... 42/71.01–74
See application file for complete search history.

(56) References Cited

U.S. PATENT DOCUMENTS

| | | | | |
|---|---|---|---|---|
| 899,617 | A * | 9/1908 | Renfors | 42/72 |
| 914,675 | A * | 3/1909 | Renfors | 42/72 |
| 1,111,905 | A * | 9/1914 | Keeran | 42/72 |
| 1,497,794 | A * | 6/1924 | Saunders | 42/94 |
| 1,557,865 | A * | 10/1925 | Neel et al. | 42/72 |
| 1,877,016 | A * | 9/1932 | Munson | 42/72 |
| 3,009,227 | A * | 11/1961 | Ryan | 24/616 |
| 3,100,357 | A * | 8/1963 | Tellie | F41C 23/04 42/72 |
| 3,553,878 | A * | 1/1971 | Canon | 42/94 |
| 3,609,902 | A * | 10/1971 | Casull | 42/62 |
| 3,977,296 | A * | 8/1976 | Silsby et al. | 89/198 |
| 4,271,623 | A * | 6/1981 | Beretta | 42/72 |
| 4,515,301 | A * | 5/1985 | A'Costa | 224/637 |
| 4,910,904 | A * | 3/1990 | Rose | 42/74 |
| 5,761,842 | A * | 6/1998 | Mantymaa | 42/71.02 |
| 5,778,588 | A * | 7/1998 | Allen et al. | 42/71.02 |
| 6,016,620 | A * | 1/2000 | Morgan | 42/94 |
| 6,481,142 | B1 * | 11/2002 | McCarthy | 42/74 |
| 7,478,495 | B1 * | 1/2009 | Alzamora et al. | 42/74 |
| 7,793,453 | B1 * | 9/2010 | Sewell et al. | 42/73 |
| 8,438,771 | B1 * | 5/2013 | Boone | 42/72 |
| 8,832,984 | B1 * | 9/2014 | Vesligaj | 42/74 |
| 8,863,428 | B2 * | 10/2014 | Vesligaj | 42/74 |
| 2002/0053156 | A1 * | 5/2002 | McCarthy | 42/74 |
| 2004/0031182 | A1 * | 2/2004 | Bentley | 42/74 |

(Continued)

FOREIGN PATENT DOCUMENTS

| | | | | |
|---|---|---|---|---|
| GB | 115953 | A * | 5/1918 | F41C 23/12 |

*Primary Examiner* — Reginald Tillman, Jr.
(74) *Attorney, Agent, or Firm* — Dunlap Bennett & Ludwig PLLC

(57) ABSTRACT

A recoil reduction apparatus is provided. The recoil reduction apparatus includes an elongated body. The elongated body has a first end and a second end. The first end may include a handle engaging surface. The handle engaging surface secures against a handle of a pistol. The second end includes a chest stop. The chest stop rests against a user's chest while firing the pistol. Therefore, the chest absorbs some of the recoil of the pistol making the pistol less intimidating.

9 Claims, 4 Drawing Sheets

(56) References Cited

U.S. PATENT DOCUMENTS

2005/0108915 A1* 5/2005 Kincel ..... 42/71.01
2007/0214697 A1* 9/2007 Ochoa ..... 42/73
2008/0110074 A1* 5/2008 Bucholtz et al. ..... 42/1.06
2011/0179687 A1* 7/2011 Caravaggi et al. ..... 42/1.06
2012/0260552 A1* 10/2012 Vesligaj ..... 42/1.06
2014/0053447 A1* 2/2014 Singh ..... 42/71.02
2014/0123528 A1* 5/2014 Vesligaj ..... 42/75.03
2014/0250756 A1* 9/2014 Vesligaj ..... 42/74
2015/0068097 A1* 3/2015 DenBleyker ..... 42/94

* cited by examiner

FIG.1
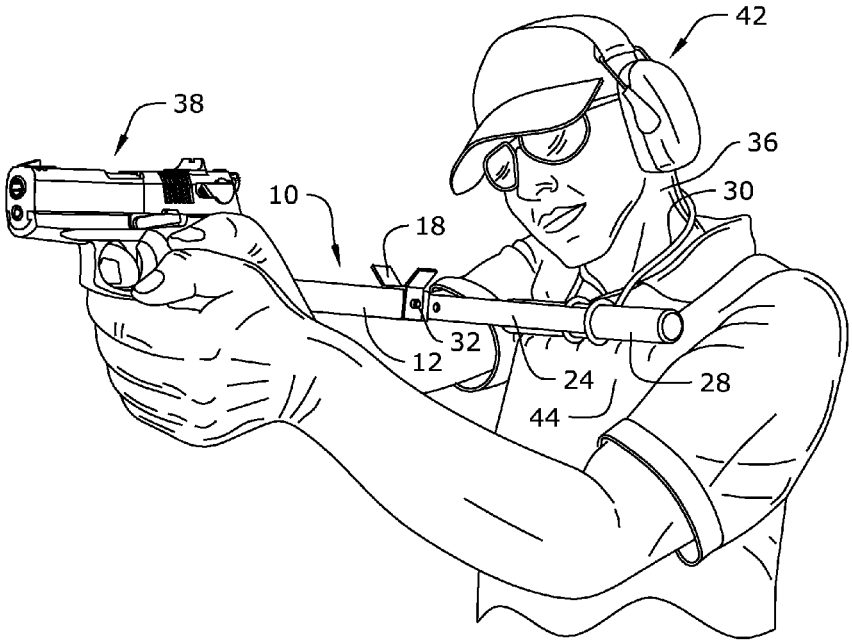
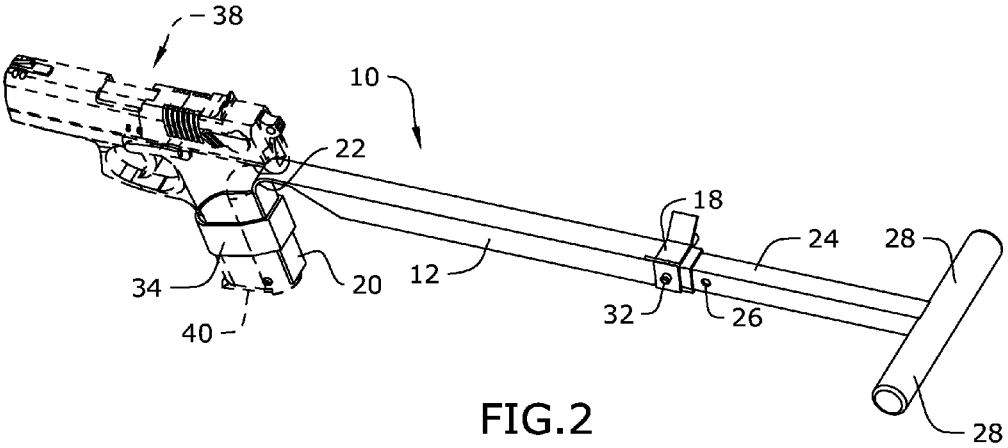
FIG.2

PISTOL RECOIL REDUCTION DEVICE

CROSS-REFERENCE TO RELATED APPLICATION

This application claims the benefit of priority of U.S. provisional application No. 61/990,784, filed May 9, 2014, the contents of which are herein incorporated by reference.

BACKGROUND OF THE INVENTION

The present invention relates to pistol recoil and, more particularly, to a device to reduce pistol recoil.

Recoil is the backward momentum of a gun when it is discharged. In most small arms, the momentum is transferred to the ground through the body of the shooter. Some people are afraid of using a handgun, because the recoil of the handgun can be uncontrollable.

As can be seen, there is a need for a device that reduces recoil of a fired pistol.

SUMMARY OF THE INVENTION

In one aspect of the present invention, a recoil reduction apparatus comprises: an elongated body having a first end and a second end, wherein the first end comprises a handle engaging surface operable to secure against a handle of a pistol, wherein the second end comprises a chest stop operable to rest against a user's chest while firing the pistol.

These and other features, aspects and advantages of the present invention will become better understood with reference to the following drawings, description and claims.

BRIEF DESCRIPTION OF THE DRAWINGS

FIG. 1 is a perspective view of an embodiment of the present invention shown in use;

FIG. 2 is a perspective view of an embodiment of the present invention;

DETAILED DESCRIPTION OF THE INVENTION

Figure 3:
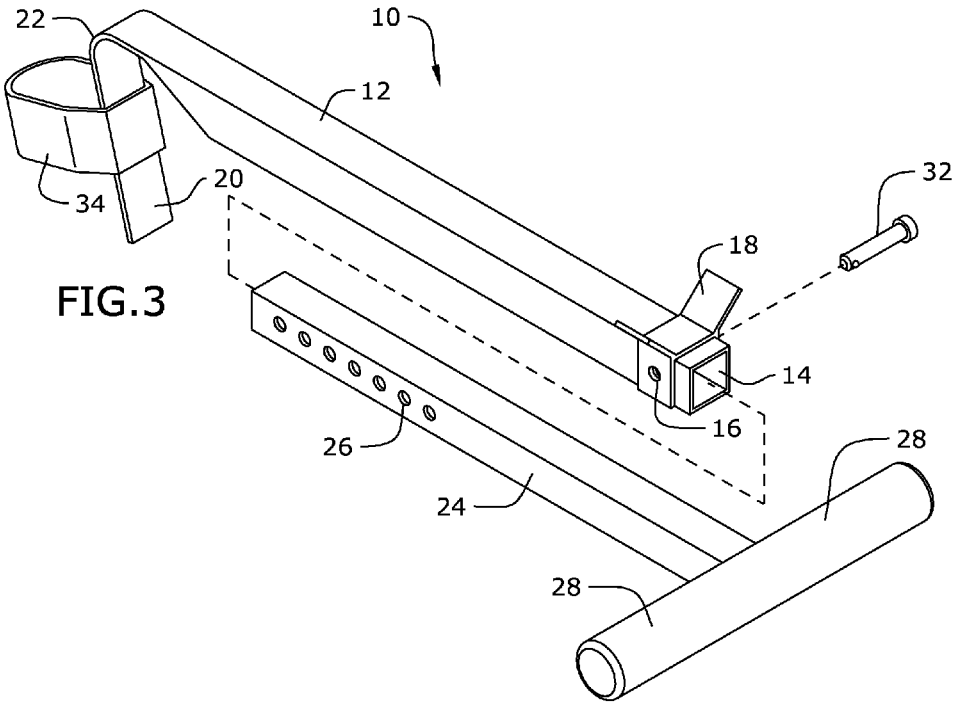
FIG. 3 is an exploded view of an embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a safety device that reduces recoil and increases control in the firing of handguns. The present invention is temporarily attached to a handgun and is linked to the shooter's chest. In the link between the handgun and the chest is a recoil reduction system. Compared to a rifle or a short barrel rifle, handguns are not as controllable when fired. The present invention provides handgun control and takes the fear of recoil out of the equation. The present invention includes a stock for a handgun that is centered in the largest part of the body, the chest. The chest stock reduces recoil and teaches people the proper technique for shooting handguns.

In certain embodiments, the chest tube butt pad is the interface between a person's chest and the chest tube, which may sit horizontally on a person's chest. A lanyard may be connected to the chest tube to allow the whole unit to hang from the neck. The recoil tube may be perpendicular to the center of the chest tube and may contain the spring rest tube and the spring assembly. The adjustment tube slides over the recoil tube and is held in place by the spring assembly. The locking pin can be used in the adjustment tube to cancel the recoil absorption of the spring assembly.

The handle assembly may be connected to the other end of the adjustment tube. The handle assembly is the interface between the handgun and the chest stock. The handle wrap goes around the handle assembly and the handgun to secure the handgun to the chest stock. The accessory bracket may be placed on the adjustment tube to store spare magazines, scope, or other items.

When the handgun is fired the handgun pushes on the handle assembly, which causes the adjustment tube to slide farther over the recoil tube at the same time compressing the spring assembly reducing the recoil of the firearm.

A handgun may be attached to the handle assembly using a wrap to hold the gun in place. A person's hand grabs the handle assembly and the handgun at the same time. The handle assembly may lie between the back of the handgun handle and the front palm of the person's hand. The adjustment tube is set to the desired length that is comfortable to the shooter. The person may place the lanyard over their head and the chest tube rests horizontally on the shooter's upper chest about four inches below the neck. While holding the handgun with two hands and applying a slight back pressure on the handgun pulls the present invention to the chest. When the handgun is fired the recoil of the handgun pushes back on the handle assembly causing the adjustment to slide over the recoil tube, which compresses the spring assembly taking away the recoil of the handgun. After the recoil is taken away the spring assembly pushes the adjustment tube forward to the handgun and the user is ready for the next shot. If the locking pin is used, the spring assembly may not compress when the handgun is fired and may cause all the recoil to be diffused into the shooters chest.

Figure 4:
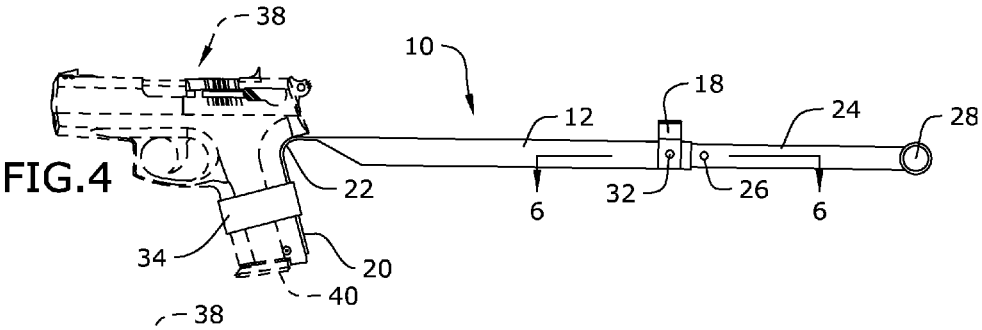
FIG. 4 is a side view of an embodiment of the present invention.
Figure 5:
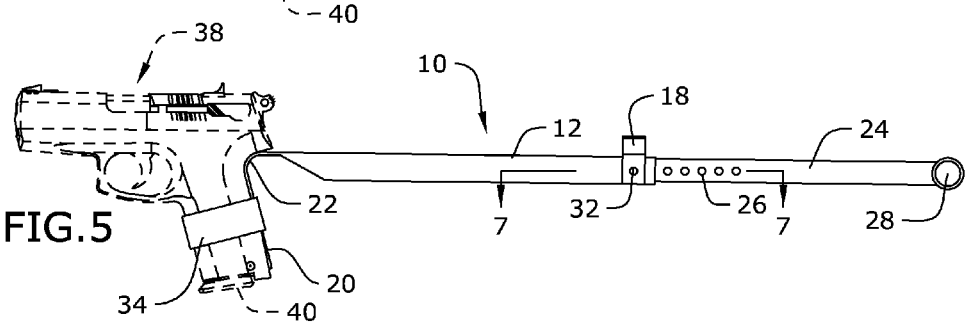
FIG. 5 is a side view of an embodiment of the present invention shown with an extended length.
Figure 6:
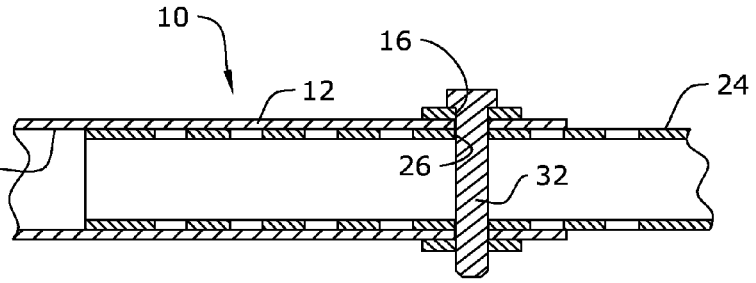
FIG. 6 is a detail section view of the present invention along line 6-6 in FIG. 4.
Figure 7:
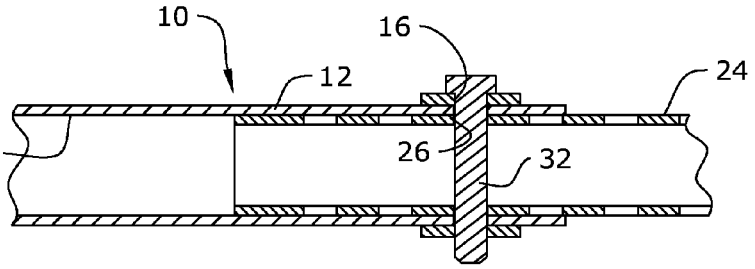
FIG. 7 is a detail section view of the present invention along line 7-7 in FIG. 5.
Figure 8:
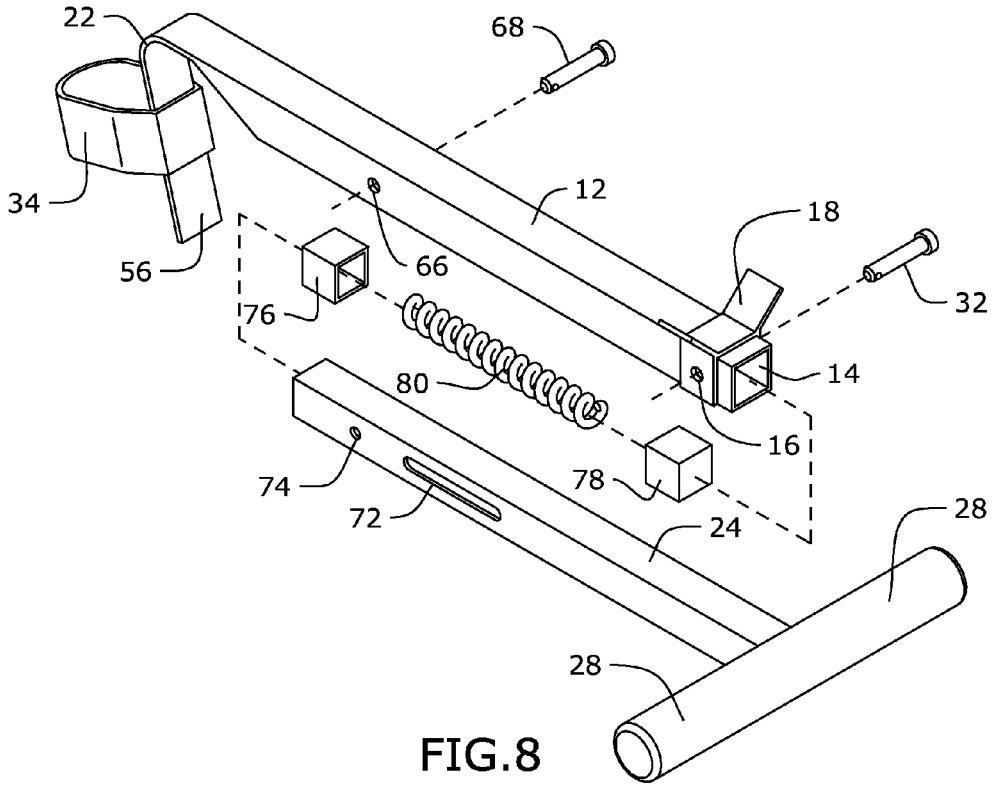
FIG. 8 is an exploded view of an embodiment of the present invention.
Figure 9:
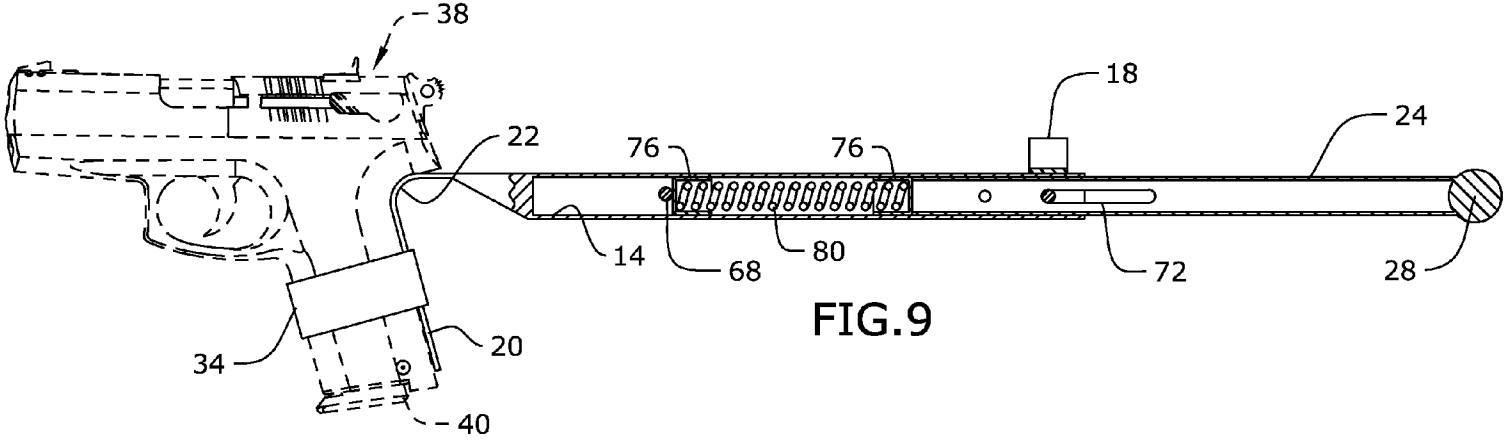
FIG. 9 is side cutaway view of an embodiment of the present invention.
Figure 10:
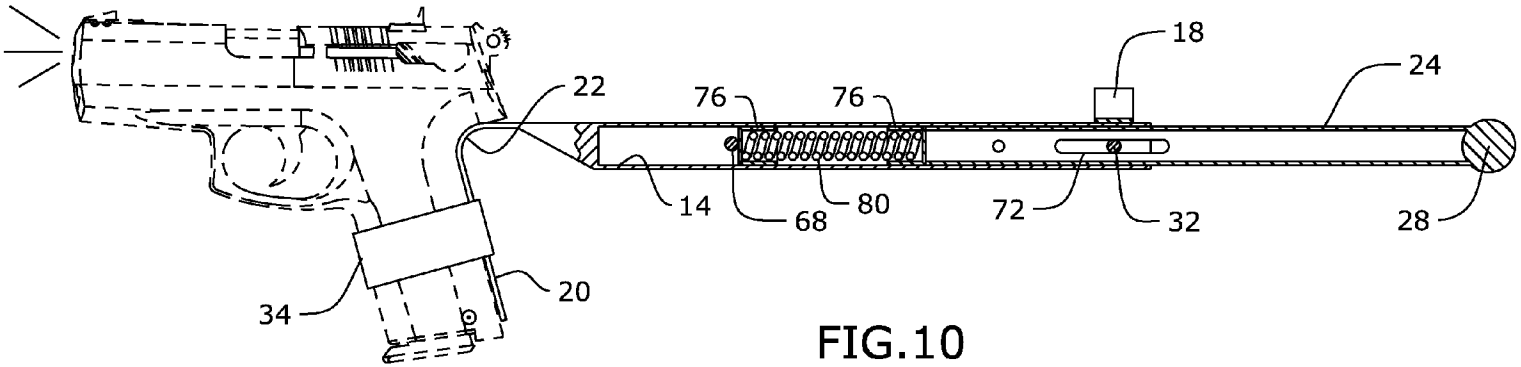
FIG. 10 is side cutaway view of an embodiment of the present invention demonstrating absorption of recoil by a spring.

Referring to FIGS. 1 through 10, the present invention includes a recoil reduction apparatus. The recoil reduction apparatus includes an elongated body 10. The elongated body 10 has a first end and a second end. The first end may include a handle engaging surface 20. The handle engaging surface 20 secures against a handle 40 of a pistol. The second end includes a chest stop 28. The chest stop 28 rests against a user's chest 44 while firing the pistol 38. Therefore, the chest 44 absorbs some of the recoil of the pistol 38 making the pistol 38 less intimidating.

As illustrated in the Figures, the handle engaging surface 20 may be formed by a bend 22 at the first end of the elongated body 10. The handle engaging surface 20 may include a substantially flat surface that curves and presses firmly against the handle 40 of the pistol 38. In certain embodiments, the present invention may include a strap 34. The strap 34 may wrap around the handle 40 and the handle engaging surface 20, further securing the pistol 38 to the recoil reduction apparatus. Alternatively, the handle engaging surface 20 may include clamps, U-shaped receivers, clips, and like that releasably engage the handle 40 of the pistol 38.

The chest stop 28 of the present invention may be secured perpendicular relative to the elongated body 10, providing additional surface area to disperse the recoil. The chest stop 28 may include an arm, a plate, and the like. The chest stop 28 may include padding to further reduce recoil. As illustrated in the Figures, the chest stop 28 may include an arm. The arm may be perpendicular to the handle 40 of the gun, unlike a typical rifle shoulder rest. Therefore, the chest stop 28 may rest against a substantial portion of the chest, evenly dispersing the recoil to the user 42. In certain embodiments, a lanyard 30 may secure the chest stop 28 to a neck 36 of the user 32. An accessory bracket 18 may be attached to the top, sides, or bottom of the elongated body 10 to attach different accessories.

In certain embodiments, the present invention may be adjustable in length. As illustrated in the Figures, the elongated body 10 may be telescopic and may include an inner pole 24 slidably engaged within an internal housing 14 of an outer pole 12. The inner pole 24 may include a plurality of locking holes 26 along a length of the inner pole 24. The outer pole 12 may include a pin hole 16. Each of locking holes 26 may align with the pin hole 16. Different locking holes 26 align with the pin hole 16 forming a different length of the elongated body 10. The locking pin 32 runs through the pin hole 16 and the corresponding locking hole 26 to lock the inner pole 24 and outer pole 12 together. Therefore, users 42 may adjust the length of the recoil reduction apparatus to accommodate their size and shooting position.

In certain embodiments, the present invention may further incorporate a spring 80 to further reduce the recoil of the pistol 38. In such embodiments, the inner pole 24 may include an elongated slot 72 and the outer pole includes the pin hole 16. The locking pin 32 runs through the pin hole 16 and into the elongated slot 72. A second pin slot 66 may be formed through the outer pole 12 closer to the handle engaging surface 20. A second pin 68 may be inserted into the second pin slot 66. A spring 80 may be suspended in between a first spring stop 76 and a second spring stop 78. The spring 80 and the spring stops 76, 78 may be within the internal housing 14 of the outer post 12 so that the first spring stop 76 is adjacent the second pin 68. The second spring stop 78 may be adjacent to an end of the inner post 24. The spring 80 may spring bias the second spring stop 78 against the end of the inner post 24, thereby spring biasing the inner post 24 away from the outer post 12. The locking pin 32 secured within the elongated slot 72 keeps the inner post 24 and the outer post 12 connected. When the gun is fired, the inner post 24 is pushed towards the outer post, the spring is compressed, and the locking pin 32 slides along the elongated slot 72, thereby reducing recoil of the pistol 38.

The present invention may be made mainly with telescoping tubing. The tubing can be different materials or different shapes if desired. The tubing may be cut to size and holes are drilled into the tubing in the appropriate places. The parts may be held together using rivets. The spring assembly may contain a spring a spring guide, washers, and a snap button that protrudes through the recoil tube and the adjustment tube, which allows the adjustment tube to be set at different distances. The handle assembly may also include telescoping tubing with a stainless steel hook that makes up the interface to the handgun. The chest tube butt pad is a foam pad that is cut to fit the chest tube. The lanyard may be an elastic material that is held in place with tubing plugs that are forced on both ends of the chest tube. The handle also has some added padding between the back of the handgun and the front of the chest stock hooked handle. The entire handle assembly may also be wrapped with a material for better protection the firearm and the hand.

It should be understood, of course, that the foregoing relates to exemplary embodiments of the invention and that modifications may be made without departing from the spirit and scope of the invention as set forth in the following claims.

What is claimed is:

1. A recoil reduction apparatus comprising:

an elongated body having a first end and a second end;

a handle engaging surface extending from the first end and substantially perpendicular relative to the elongated body, wherein the handle engaging surface is operable to secure against a rear portion of a handle of a pistol; and a chest stop secured to the second end of the elongated body, wherein the chest stop comprises a tube comprising a length greater than a width and having a padding, wherein the length of the tube is substantially perpendicular with the elongated body and the handle of the pistol and operable to rest against a user's chest while firing the pistol.

2. The recoil reduction apparatus of claim 1, wherein the elongated body is adjustable in length.

3. The recoil reduction apparatus of claim 2, wherein the elongated body is telescopic and comprises an inner pole slidably engaged within an outer pole.

4. The recoil reduction apparatus of claim 3, further comprising a locking pin, wherein the inner pole comprises a plurality of locking holes along a length and the outer pole comprises a pin hole, wherein each of the plurality of locking holes aligns with the pin hole forming a different length of the elongated body, wherein the locking pin runs through the pin hole and the corresponding locking hole to lock the inner pole and outer pole together.

5. The recoil reduction apparatus of claim 1, wherein the handle engaging surface comprises a bend and a flat surface substantially perpendicular with the elongated body.

6. The recoil reduction apparatus of claim 1, further comprising a strap sized to wrap around the handle of the pistol and the handle engaging surface.

7. The recoil reduction apparatus of claim 3, further comprising a locking pin, wherein the inner pole comprises an elongated slot and the outer pole comprises a pin hole, wherein the locking pin runs through the pin hole and into the elongated slot.

8. The recoil reduction apparatus of claim 7, further comprising a spring within the outer pole and spring biasing the inner pole away from the outer pole.

9. A recoil reduction apparatus comprising:

an elongated body having a first end and a second end;

a handle engaging surface extending from the first end and substantially perpendicular relative to the elongated body, wherein the handle engaging surface comprises a bend and a flat surface substantially perpendicular with the elongated body, wherein the flat surface is operable to secure against a rear portion of a handle of a pistol; and a chest stop secured to the second end of the elongated body, wherein the chest stop comprises a cylindrical tube having a padding, wherein the cylindrical tube is substantially perpendicular with the elongated body and the handle of the pistol and operable to rest against a user's chest while firing the pistol.

* * * * *